US010900445B2

(12) United States Patent
Grill

(10) Patent No.: US 10,900,445 B2
(45) Date of Patent: Jan. 26, 2021

(54) EXHAUST GAS RECIRCULATION COOLER

(71) Applicant: Mahle International GmbH, Stuttgart (DE)

(72) Inventor: Oliver Grill, Moetzingen (DE)

(73) Assignee: Mahle International GmbH

( * ) Notice: Subject to any disclaimer, the term of this patent is extended or adjusted under 35 U.S.C. 154(b) by 127 days.

(21) Appl. No.: 16/191,159

(22) Filed: Nov. 14, 2018

(65) Prior Publication Data

US 2019/0145358 A1 May 16, 2019

(30) Foreign Application Priority Data

Nov. 15, 2017 (DE) ..... 10 2017 220 347

(51) Int. Cl.
*F02M 26/29* (2016.01)
*F02M 26/11* (2016.01)
(Continued)

(52) U.S. Cl.
CPC ..... *F02M 26/29* (2016.02); *F02M 26/11* (2016.02); *F02M 26/38* (2016.02); *F02M 26/65* (2016.02); *F02B 47/08* (2013.01)

(58) Field of Classification Search
CPC ..... F02M 26/32; F02M 26/31; F02M 26/30; F02M 26/29; F02M 26/69; F02M 26/38; F02M 26/11; F02M 26/65; F02B 47/08
See application file for complete search history.

(56) References Cited

U.S. PATENT DOCUMENTS 4,074,700 A * 2/1978 Engle ..... B60T 8/3615 137/625.27
2009/0014679 A1* 1/2009 Hygema ..... B65D 83/565 251/368

(Continued)

FOREIGN PATENT DOCUMENTS

DE 100 18 503 A1 10/2001
DE 102010005116 A1 7/2011

(Continued)

OTHER PUBLICATIONS

200507 DE102010054644 machine translation (Year: 2010).*

(Continued)

*Primary Examiner* — Carl C Staubach
(74) *Attorney, Agent, or Firm* — Fishman Stewart PLLC

(57) ABSTRACT

An exhaust gas recirculation cooler may include a heat exchanger block including a first mounting flange, a diffuser including a second mounting flange, and at least one non-return valve arranged between the heat exchanger block and the diffuser. The exhaust gas recirculation cooler may also include a valve carrier which supports the at least one non-return valve and on which a gasket is arranged. The heat exchanger block may be connected via the first mounting flange directly to the second mounting flange of the diffuser. The valve carrier may be arranged between the heat exchanger block and the diffuser, and with the gasket may seal a sealing point between the first mounting flange and the second mounting flange. The diffuser may include an outwardly closed recess with a peripheral rim structured to accommodate the valve carrier. The rim may define the second mounting flange.

20 Claims, 2 Drawing Sheets

(51) Int. Cl.

| | |
|---|---|
| ***F02M 26/38*** | (2016.01) |
| ***F02M 26/65*** | (2016.01) |
| *F02B 47/08* | (2006.01) |

(56) References Cited

U.S. PATENT DOCUMENTS

| | | | | |
|---|---|---|---|---|
| 2009/0165449 | A1* | 7/2009 | Christ | F16K 49/005 60/320 |
| 2013/0025577 | A1* | 1/2013 | Huesges | F02M 26/44 123/568.12 |

FOREIGN PATENT DOCUMENTS

| | | | | |
|---|---|---|---|---|
| DE | 102010005136 | B3 | 7/2011 | |
| DE | 102010054644 | A1 * | 6/2012 | F02M 26/32 |
| DE | 10 2010 054 644 | B4 | 12/2012 | |
| DE | 102015014090 | A1 | 5/2017 | |

OTHER PUBLICATIONS

English abstract for DE-100 18 503.
English abstract for DE-10 2010 054 644.
English abstract for DE-102010005136.
English abstract for DE-102015014090.
English abstract for DE-102010005116.

* cited by examiner

EXHAUST GAS RECIRCULATION COOLER

CROSS-REFERENCE TO RELATED APPLICATION

This application claims priority to German Application No. DE 10 2017 220 347.1, filed on Nov. 15, 2017, the contents of which are hereby incorporated by reference in its entirety.

TECHNICAL FIELD

The present invention relates to an exhaust gas recirculation cooler with a heat exchanger block and a diffuser. The invention also relates to an internal combustion engine having at least one such exhaust gas recirculation cooler.

BACKGROUND

A species-related exhaust gas recirculation cooler having a heat exchanger block with a first mounting flange and a diffuser with a second mounting flange is known from DE 10 2010 054 644 B4. In this context, two non-return valves are arranged between the heat exchanger block and the diffuser, and each blocks a flow of exhaust gas in one direction.

An exhaust gas recirculation device for an internal combustion engine having at least two exhaust gas recirculation lines which branch off from corresponding exhaust gas lines of the internal combustion engine and discharge separately or jointly into an intercooler is known from DE 100 18 503 A1. Viewed in the direction of flow, at least one cooling system with at least two non-return valves and at least one exhaust gas recirculation valve is provided, wherein the cooling system includes a housing with at least two exhaust gas flow channels which are constructed such that at least twin-pipe recirculation of the exhaust gas can be assured as far as the non-return valves.

In general, in order to achieve the exhaust gas emission levels prescribed by law, it is necessary to return cooled exhaust gas for combustion again. In this case, the exhaust gas is cooled in an exhaust gas recirculation cooler. Non-return valves are used to prevent undesirable reflux of the exhaust gas. These are usually arranged on an intermediate flange downstream of a heat exchanger block in the exhaust gas recirculation cooler. This intermediate flange is installed between the heat exchanger block and a downstream diffuser and normally consists of a steel or aluminium component, wherein the component may also be produced in particular from a full milled part or a cast part and the machining work entailed thereby. However, the installation of the intermediate flange which is necessary for the arrangement of the non-return valve creates at least two sealing points in the exhaust gas steam, which must be sealed so that no exhaust gas can escape to the outside. In this situation, a metal bead gasket is therefore inserted between the heat exchanger block and the intermediate flange, while the seal between the intermediate flange and the diffuser is assured with the appropriate gaskets on the non-return valves. However, in this context the requirements for machining the sealing surfaces on the intermediate flange and on the diffuser are correspondingly demanding and expensive.

SUMMARY

The present invention therefore concerns itself with the problem of describing an improved or at least alternative embodiment for an exhaust gas recirculation cooler of the species-related type which overcomes the disadvantages known from the related art.

This problem is solved according to the invention with the object of the independent claim(s). Advantageous embodiments are the objects of the dependent claim(s).

The present invention is based on the general idea of significantly reducing the number of interfaces and therewith the number of outward sealing points in an exhaust gas recirculation cooler with non-return valves, and thus to enable a less expensive, functionally more reliable design of the cooler. The exhaust gas recirculation cooler according to the invention has a heat exchanger block with a first mounting flange and a diffuser with a second mounting flange, wherein at least one non-return valve is arranged in the area of the diffuser, or between the heat exchanger block and the diffuser, to enable an undesirable reflux of exhaust gas to be prevented. According to the invention, now a valve carrier is provided which supports the at least one non-return valve and on which at the same time a gasket is arranged. The heat exchanger block is also connected directly, for example screwed to the second mounting flange of the diffuser via its first mounting flange, wherein the valve carrier is arranged between the heat exchanger block and the diffuser and seals an outward sealing point between the first mounting flange and the second mounting flange with the gasket. This means that the intermediate flange which was previously arranged between the heat exchanger block and the diffuser is no longer needed, and consequently the metal bead gasket which previously had to be provided in this this area between the heat exchanger block and the intermediate flange may also be dispensed with. A gasket between the intermediate flange and the diffuser may also be omitted. The previous number of two outward sealing points may now also be halved, so that now only a single outward sealing point is provided between the two mounting flanges, which can be sealed easily for example with the gasket that is arranged, for example moulded onto the valve carrier. In such a case, the valve carrier is integrated in the installation spaced between the diffuser and the heat exchanger block in such manner that there is now only a single outward interface, regardless of the number of non-return valves. This is also achieved according to the invention by providing the diffuser with an outwardly closed recess having a peripheral rim to accommodate the valve carrier, wherein the rim forms the second mounting flange. In this way, the peripheral rim then clasps behind the valve carrier and its gasket, and in particular reduces the number of sealing points to one at the most, regardless of the number of non-return valves. This makes it possible to produce the exhaust gas recirculation cooler according to the invention considerably less expensively and with considerably larger manufacturing tolerances. With the omission of the metal bead gaskets, for example, the previously extremely strict requirements regarding flatness and other tolerances applied to the sealing surfaces of the adjacent components may be relaxed, which in turn also enables the diffuser and for example a housing of the heat exchanger block—on which the first mounting flange is arranged—to be produced more simply and less expensively. Purely theoretically, of course, it is also conceivable that the recess to accommodate the valve carrier according to the invention is provided in the area of the first mounting flange of the heat exchanger block. And it is also conceivable that a proportional, particularly halved recess to accommodate the valve carrier is provided on both the first mounting flange of the heat exchanger block and in the area of the second mounting flange on the diffuser.

In an advantageous further development of the solution according to the invention, the valve carrier is made from plastic, particularly as a plastic injection moulded part. The greatest advantage of this is that it enables the valve carrier to be made not only inexpensively also in extremely high quality. The required properties may also be obtained relatively easily with the selection of an appropriate plastic.

In another advantageous embodiment of the solution according to the invention, the valve carrier may alternatively be made from steel or aluminium. This enables a particularly rigid version of the valve carrier to be made, on which the gasket is moulded, for example. The variant made of steel or aluminium may conceivably be used for high-quality equipment lines, for example. Purely theoretically, it is also possible to envisage designing the valve carrier and the gasket as a two-component plastic part, so that they may be produced in a single, common manufacturing step. In particularly this also makes it possible to use a different plastic for the valve carrier than is used for the gasket, so the gasket may be made from ethylene propylene diene monomer (EPDM) rubber for example.

In a further advantageous embodiment of the solution according to the invention, at least two separate exhaust gas channels and two non-return valves are provided, which are supported by the valve carrier. With the exhaust gas recirculation cooler according to the invention, in principle it is irrelevant whether the cooler is designed with one, two or more channels, since the recess provided in the diffuser to accommodate the valve carrier thereby necessitating only a single sealing point a variable number of exhaust gas channels and non-return valves means that they may be produced with just a single outward sealing point.

In a further advantageous embodiment of the solution according to the invention, the diffuser is designed such that it causes a redirection an exhaust gas stream through about 90°. In this way, it is possible for example to arrange the exhaust gas cooler directly on the internal combustion engine or directly on another component, in particular so that an arrangement optimised for the installation space may be created.

The diffuser is advantageously made of metal or plastic. The diffuser, which is arranged for example downstream of the heat exchanger block, may be made from plastic, for example, since in this case the exhaust gases are already cooled and do not represent a temperature-critical load for the diffuser.

The present invention is further based on the general idea of equipping an internal combustion engine with at least one exhaust gas recirculation cooler of such kind, and thus transferring the aforementioned advantages of fewer sealing points and the consequently cheaper manufacture and greater functional reliability to the internal combustion engine.

Further important features and advantages of the invention will be evident from the subclaims, the drawings and the associated description of the figures with reference to the drawings.

Of course, the features described in the preceding text and those which will be explained below are usable not only in the combination indicated in each case, but also in other combinations or alone without departing from the scope of the present invention.

Preferred embodiments of the invention are represented in the drawings and will be explained in greater detail in the following description, wherein the same reference signs will be used for identical or similar or functionally equivalent components.

DETAILED DESCRIPTION

Figure 1:
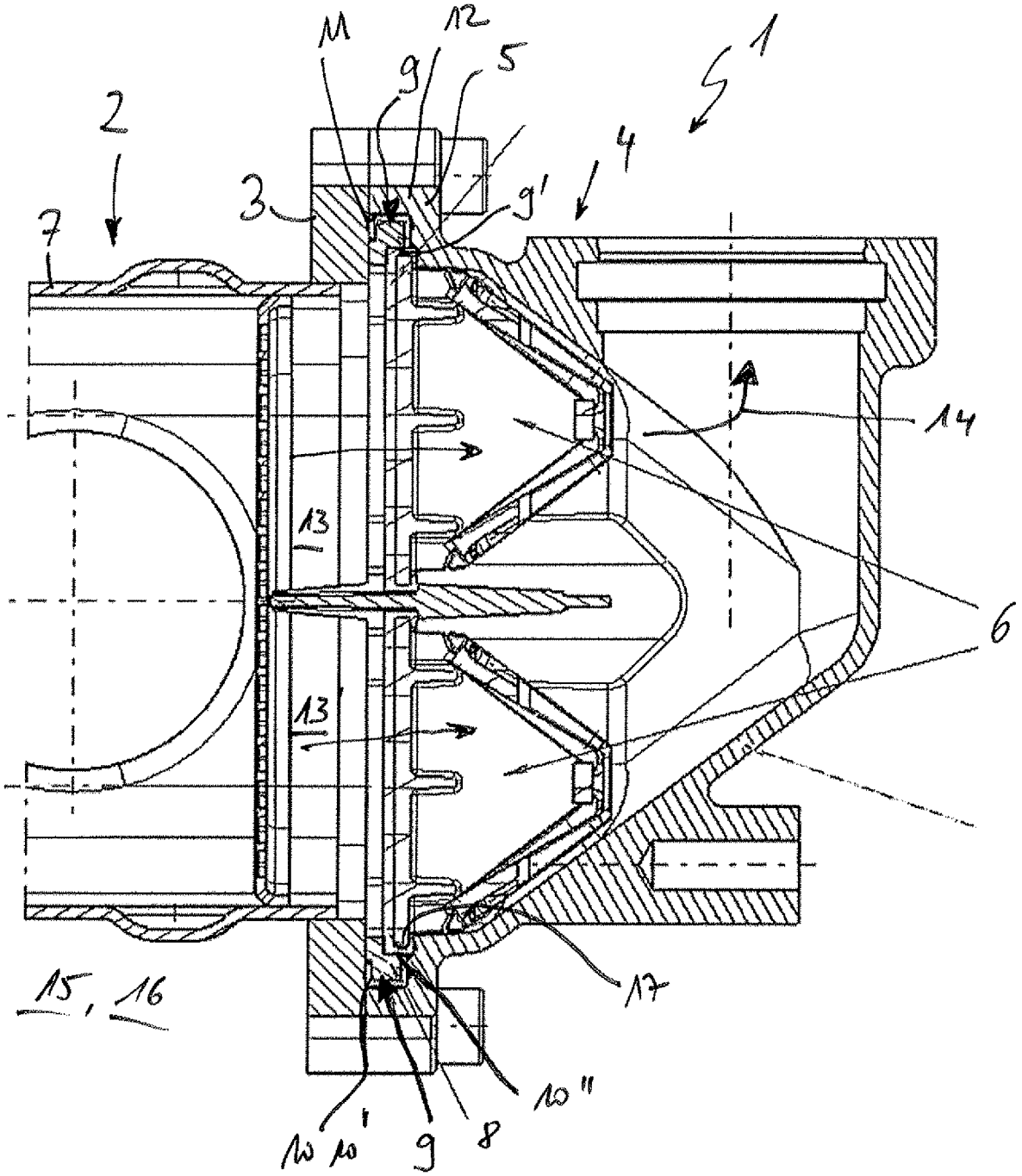
FIG. 1 is a schematic representation of a cross section through an exhaust gas recirculation cooler according to the invention.
Figure 2:
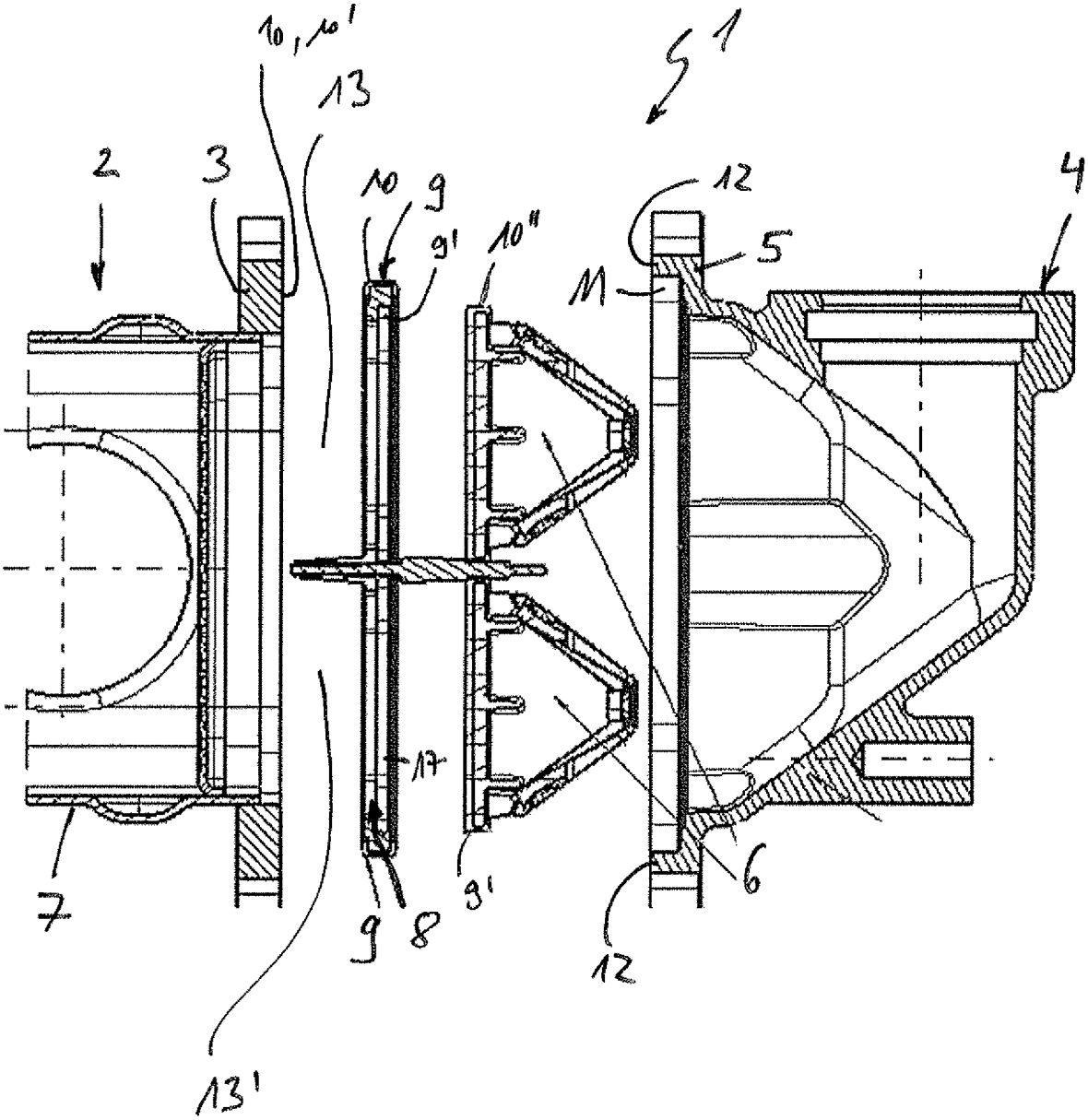
FIG. 2 is a schematic representation of the device of FIG. 1 but in exploded view.

According to FIGS. 1 and 2, an exhaust gas recirculation cooler 1 according to the invention has a heat exchanger block 2 with a first mounting flange 3, and a diffuser 4 with a second mounting flange 5. At least one, in this case in fact two, non-return valves 6 are arranged between the heat exchanger block 2 and the diffuser 4. These are intended to prevent undesirable reflux of exhaust gas 14. The first mounting flange 3 may be constructed integrally with a housing 7 of the heat exchanger block 2 or also attached thereto. According to the invention, a valve carrier 8 (see FIG. 2 in particular) is provided, which supports the at least one non-return valve 6, in this case the two non-return valves 6, and on which at the same time a gasket 9 is arranged, particularly moulded. The heat exchanger block 2 is connected directly via its first mounting flange 3 to the second mounting flange 5 of the diffuser 4, wherein the valve carrier 8 is arranged between the heat exchanger block 2 and the diffuser 4 and seals a sealing 10, which may also be described as an outer sealing point 10' between the first mounting flange 3 and the second mounting flange 5 with the gasket 9.

In the exhaust gas recirculation cooler known from the related art, an intermediate flange was also arranged between the diffuser 4 and the heat exchanger block 2, on which the non-return valves 6 were supported. However, this embodiment necessitates the user of two outer sealing point 10', one between the intermediate flange and the first mounting flange 3 of the heat exchanger block 2 and the other between the intermediate flange and the second mounting flange 5 of the diffuser 4. Now with the exhaust gas recirculation cooler 1 according to the invention, this may be reduced to only a single outer sealing point 10'. This is also made possible by the fact the diffuser 4 has an outwardly closed recess 11 having a peripheral rim 12 to accommodate the valve carrier 8, wherein said rim 12 at the same time forms the second mounting flange 5 with a direct contact surface with the first mounting flange 3. Purely theoretically of course, it is also conceivable that at least part of the recess 11 to accommodate the valve carrier 8 may also be provided in the first mounting flange 3 of the heat exchanger block 2. All in all, however, the exhaust gas recirculation cooler according to the invention enables the number of outer sealing points 10' to be reduced from two as was the case previously to just one single point now according to the invention, so that the seal between the heat exchanger block 2 and the diffuser 4 may be designed not only less expensively but also more functionally reliably. In particular, with the exhaust gas recirculation cooler 1 according to the invention, the previously essential intermediate flange may also be dispensed with, resulting in an reduction of the number of parts quired and consequently also of the associated assembly, storage and logistical costs.

The valve carrier 8 may be constructed for example from plastic, in particular a s plastic injection moulded part, enabling it to be produced not only inexpensively but also to a high quality standard. In this context, of course the valve carrier 8 and the gasket 9 may also be constructed as "bi-component" injection moulded plastic components or a two-component plastic part, which in turn makes it possible to use different plastics for the valve carrier 8 on the one hand and the gasket 9 on the other. For the gasket 9, EPDM is a possible material, for example.

Production of the valve carrier 8 and the gasket 9 as a two-component plastic part in particular make it possible to dispense with labour-intensive, expensive post-processing. It is also conceivable that the valve carrier 8 and the gasket 9 may easily be installed in the exhaust gas recirculation cooler together.

Purely theoretically, of course it is also conceivable for the gasket 9 to be moulded onto a separately produced valve carrier 8 made of plastic, steel or aluminium, and is connected thereto in this way. The moulded construction and/or construction of the valve carrier 8 with the gasket 9 as a bi-component injection moulded plastic part may serve to obtain a particularly leak-proof and reliable attachment between the gasket 9 and the valve carrier 8.

Upon further review of FIGS. 1 and 2, it may be seen that the exhaust gas recirculation cooler 1 according to the invention has two separate exhaust gas channels 13, 13' and two associated non-return valves 6, which are supported by the valve carrier 8 and in particular are inserted in seatings 17 therein. In this case, a gasket 9' may be arranged on the seating 17 and/or on the non-return valve 6, thereby sealing an inner sealing point 10".

At the same time, the diffuser 4 shown in FIGS. 1 and 2 is constructed in such manner that it causes a redirection of an exhaust gas stream 14 through about 90°. The diffuser 4 itself may be made for example from metal or plastic, wherein the non-return valves 6 and thus also the valve carrier 8 may be arranged downstream and/or upstream from the heat exchanger block 2 in the direction of the flow.

The exhaust gas recirculation cooler 1 according to the invention may be installed in a motor vehicle 15, particularly in an internal combustion engine 16.

With the exhaust gas recirculation cooler 1 according to the invention, it is possible to reduce the number of outer sealing point 10' by half, regardless of the number of exhaust gas channels 13, 13', and also regardless of the number of non-return valves 6, so that for any embodiment only a single sealing point 10' has to be sealed off from the outside. This in turn enables production and manufacturing costs to be reduced, particularly in terms of the flatness and tolerances on the sealing surfaces of the mounting flanges 3, 5.

The invention claimed is:

1. An exhaust gas recirculation cooler, comprising:

a heat exchanger block including a first mounting flange;

a diffuser including a second mounting flange;

at least one non-return valve arranged between the heat exchanger block and the diffuser; and a valve carrier which supports the at least one non-return valve and on which a gasket is arranged;

the heat exchanger block connected via the first mounting flange directly to the second mounting flange of the diffuser;

wherein the valve carrier is arranged between the heat exchanger block and the diffuser, and with the gasket seals a sealing point between the first mounting flange and the second mounting flange;

wherein the diffuser includes (i) a recess in which the valve carrier is disposed and retained, and (ii) a peripheral rim extending around and defining an outer radial boundary of the recess; and wherein the rim defines the second mounting flange.

2. The exhaust gas recirculation cooler according to claim 1, wherein the valve carrier and the gasket are structured as a 2-part plastic component.

3. The exhaust gas recirculation cooler according to claim 1, wherein the valve carrier is composed of at least one of steel and aluminium.

4. The exhaust gas recirculation cooler according to claim 1, wherein the gasket is secured via moulding onto the valve carrier.

5. The exhaust gas recirculation cooler according to claim 1, further comprising at least two separate exhaust gas channels, wherein the at least one non-return valve includes two non-return valves supported by the valve carrier each associated with a respective one of the at least two exhaust gas channels.

6. The exhaust gas recirculation cooler according to claim 1, wherein the diffuser is structured such that an exhaust gas flow flowable therethrough is redirected at about 90°.

7. The exhaust gas recirculation cooler according to claim 1, wherein the valve carrier includes at least one seating structured to accommodate the at least one non-return valve, and wherein another gasket is arranged on at least one of the at least one seating and the at least one non-return valve.

8. An internal combustion engine comprising at least one exhaust gas recirculation cooler including:

a heat exchanger block including a first mounting flange;

a diffuser including a recess and a peripheral rim defining a second mounting flange, the heat exchanger block connected via the first mounting flange directly to the second mounting flange;

at least one non-return valve arranged between the heat exchanger block and the diffuser; and a valve carrier supporting the at least one non-return valve and on which a gasket is arranged, the valve carrier arranged between the heat exchanger block and the diffuser such that the gasket abuts against the first mounting flange and the second mounting flange sealing a sealing point therebetween;

wherein the valve carrier is disposed and retained within the recess; and wherein the rim extends around and defines an outer radial boundary of the recess.

9. The internal combustion engine according to claim 8, wherein the valve carrier and the gasket are structured as a 2-part plastic component.

10. The internal combustion engine according to claim 8, wherein the gasket is arranged on and connected to the valve carrier via a moulded-on connection.

11. The internal combustion engine according to claim 8, further comprising at least two separate exhaust gas channels, wherein the at least one non-return valve includes two non-return valves supported by the valve carrier each associated with a respective one of the at least two exhaust gas channels.

12. The internal combustion engine according to claim 8, wherein the diffuser is structured such that an exhaust gas flow flowable therethrough is redirected at about 90°.

13. The internal combustion engine according to claim 8, wherein the valve carrier includes at least one seating structured to accommodate the at least one non-return valve, and wherein another gasket is arranged on at least one of the at least one seating and the at least one non-return valve.

14. An exhaust gas recirculation cooler, comprising:

a heat exchanger block including a first mounting flange;

a diffuser including a recess and a peripheral rim defining a second mounting flange, the heat exchanger block connected via the first mounting flange directly to the second mounting flange such that only a single sealing point is present between the heat exchanger block and the diffuser;

at least two separate exhaust gas channels;

at least two non-return valves each associated with a respective one of the at least two exhaust gas channels arranged between the heat exchanger block and the diffuser; and a valve carrier supporting the at least two non-return valves and on which a gasket is arranged, the valve carrier arranged between the heat exchanger block and the diffuser such that the valve carrier and the gasket seal the single sealing point between the first mounting flange and the second mounting flange;

wherein the valve carrier is disposed and retained within the recess; and wherein the rim extends around and defines an outer radial boundary of the recess.

15. The exhaust gas recirculation cooler according to claim 14, wherein the valve carrier includes at least two seatings each structured to accommodate an associated one of the at least two non-return valves.

16. The exhaust gas recirculation cooler according to claim 15, further comprising another gasket arranged on at least one of (i) at least one of the at least two seatings and (ii) at least one of the at least two non-return valves.

17. The exhaust gas recirculation cooler according to claim 1, wherein the gasket abuts against the first mounting flange and the second mounting flange sealing a sealing point therebetween.

18. The exhaust gas recirculation cooler according to claim 1, wherein the heat exchanger block and the diffuser are directly connected to one another via the first mounting flange and the second mounting flange such that only a single sealing point is present between the heat exchanger block and the diffuser.

19. The exhaust gas recirculation cooler according to claim 1, wherein:

the recess is an annular recess defined by and between the first mounting flange and the second mounting flange; and at least a portion of the at least one non-return valve is disposed and retained within the annular recess.

20. The exhaust gas recirculation cooler according to claim 19, wherein the gasket is arranged within the recess and abuts against the first mounting flange and the second mounting flange sealing a sealing point therebetween.

* * * * *